US008679223B2

(12) United States Patent
Sheng

(10) Patent No.: US 8,679,223 B2
(45) Date of Patent: Mar. 25, 2014

(54) METHOD FOR SCOOPING-UP SLAG FROM LIQUID IRON

(76) Inventor: Fuchun Sheng, Shandong (CN)

( * ) Notice: Subject to any disclaimer, the term of this patent is extended or adjusted under 35 U.S.C. 154(b) by 0 days.

(21) Appl. No.: 13/411,217

(22) Filed: Mar. 2, 2012

(65) Prior Publication Data

US 2012/0167718 A1 Jul. 5, 2012

Related U.S. Application Data

(62) Division of application No. 10/582,864, filed as application No. PCT/CN2004/000308 on Apr. 5, 2004, now Pat. No. 8,153,050.

(30) Foreign Application Priority Data

Dec. 15, 2003 (CN) ..... 2003 1 0121101

(51) Int. Cl.
*C22B 7/04* (2006.01)
*C22B 9/00* (2006.01)

(52) U.S. Cl.
USPC ..... 75/582; 266/44

(58) Field of Classification Search
USPC ..... 75/582; 266/44
See application file for complete search history.

(56) References Cited

U.S. PATENT DOCUMENTS 3,360,254 A * 12/1967 Karl-Heinz Hellmund .. 266/228
3,610,603 A * 10/1971 Schmitz ..... 266/228
3,894,728 A * 7/1975 Berkens ..... 266/228
3,929,638 A * 12/1975 Hamilius ..... 75/582
4,072,505 A * 2/1978 Hausen et al. ..... 75/570
4,153,965 A 5/1979 Merly et al.
5,360,204 A 11/1994 Mancuso

FOREIGN PATENT DOCUMENTS

| | | | |
|---|---|---|---|
| CN | 1225300 | A | 8/1999 |
| CN | 2381419 | Y | 6/2000 |
| JP | 02130389 | A | 5/1990 |
| JP | 10005988 | A | 1/1998 |
| JP | 2000227282 | A | 8/2000 |
| WO | 9960177 | A1 | 11/1999 |

OTHER PUBLICATIONS

Qin Xizhu et al., Iron Alloy, 1995 (2), p. 32-33.

* cited by examiner

*Primary Examiner* — George Wyszomierski
*Assistant Examiner* — Tima M McGurthry Banks
(74) *Attorney, Agent, or Firm* — Birch, Stewart, Kolasch & Birch, LLP

(57) ABSTRACT

The present invention provides a high efficiency method for scooping-up slag from liquid iron in a ladle. The two wings of slag rake mounted to the front end of cantilever descend side by side until beneath the surface of the liquid iron at a certain depth. The two rakes make swinging movements, respectively, along the surface of liquid iron. When gradually moving close to each other during the swinging movement, the slag rakes push together and clamp the solid slag. While clamping the slag, the two slag rakes are driven upwardly by the cantilever until they are above the surface by a certain height. Finally, the slag rakes leave the space over the ladle, and discharge the slag. The de-slagging rate can reach over 90%, and the process takes less than 3 minutes. Additionally, the iron carried away while scooping-up the slag can be strictly controlled within 0.1%.

8 Claims, 1 Drawing Sheet

METHOD FOR SCOOPING-UP SLAG FROM LIQUID IRON

CROSS-REFERENCE TO RELATED APPLICATION

The present application claims priority under 35 U.S.C. §119 to Chinese Patent Application No. 2003 10121101.8 filed Dec. 15, 2003, and PCT/CN Patent Application 2004/000308, filed Apr. 5, 2004, and is a Divisional Application of U.S. patent application Ser. No. 10/582,864 filed Jun. 4, 2009, which issued as U.S. Pat. No. 8,153,050 on Apr. 10, 2012. The entire contents of the above-identified applications are hereby incorporated by reference.

BACKGROUND OF THE INVENTION

1. Technical Field of the Invention

The present invention generally relates to the field of smelting technology. More particularly, it relates to a method of high efficient dross removal from the surface of liquid iron 2. Background of the Invention After the pre-treatment of desulfurization, desiliconization and dephosphorization, the liquid iron will produce a great amount of solid slag which floats on its surface. The solid slag must be removed away promptly. Otherwise it may impair the pretreatment effect of the liquid iron, leading to the rise in production cost of the next processes.

The existing slagging-off device (scooping-up device) in the process of pretreatment of liquid iron has been used since the 1950's or 1960's. This kind of slagging-off machine for liquid iron is of linear reciprocating type, driven mechanically or hydraulically. A slag rake, which is made of refractory material, is mounted on a cantilever of the machine. By immersing the rake into the liquid iron to a certain depth and making it moving along the surface of liquid iron in linear or curved reciprocating manner, it can rake out the solid slag floating on the surface of liquid iron in the ladle gradually.

However, the conventional slagging-off technique and the equipment have disadvantages as follows:

(1) Long time taking for the work of slagging-off, and low working efficiency. Normally, it would need to reciprocate for over ten or even tens of times, which takes 5 to 10 minutes;

(2) Incomplete de-slagging and low de-lagging rate. By adding a slag adhesive agent or a slagging-off agent so as to conglomerate the slag, the de-slagging rate can just reach 80% to its maximum. The incomplete de-slagging would directly bring about much more resulfurization in converter or electric furnace;

(3) Liable to carry away liquid iron while raking out slag, generally with an iron loss between 0.5% and 1.0%. These problems have already become a worldwide problem that troubles the international iron and steel industry and constrains the development in this field. The direct economic loss incurred thereof is over 0.5 billion US dollars each year.

Over the recent years, rapid development has been seen in China's iron and steel industry, with an overall yield reaching the first place in the world. It was estimated that a pretreatment amount of liquid iron could reach 50 million tons in 2003. But, as the technology and equipment are relatively backward, the actual iron loss rate is mostly around 1.0%. Together with the economic loss caused by resulfurization in converters and electric furnaces, the direct economic loss a year would be over 0.5 billion RMB.

SUMMARY AND OBJECTS OF THE INVENTION

In order to overcome the disadvantages of the existing method and equipment for the process of slagging-off for liquid iron as mentioned above, the present invention is to provide a new and high efficient slagging-off method and a device for implementing said method. The swing movement is adopted in the slagging-off technology in the present application. It makes the process more speedy and efficient, and reduces the iron loss significantly.

The method of high efficiency slagging-off for liquid iron of the present invention is described as follows: The two wings of slag rakes mounted to the front end of cantilever make swinging movements respectively along the surface of liquid iron. When gradually moving close to each other, they get put together and clamp the solid slag. Then, driven by the cantilever, the two slag rakes move back to the vicinity of the edge of the liquid iron ladle and discharge the slag.

First, the two slag rakes descend side by side until beneath the surface of the liquid iron at a certain depth. Then after the swing movement, they are brought to ascend by the cantilever until above the surface at a certain height. Finally, the two slag rakes are driven by the cantilever to move to the outside of the edge of liquid iron ladle and discharge the slag.

A device for implementing the aforesaid high efficient method of slagging-off for liquid iron, comprising a flatcar track, a flatcar which reciprocates along the flatcar track and a cantilever which is connected to the flatcar by means of a hoisting main shaft. The rack is fitted in the drive case at the front end of the cantilever. It is engaged with the gears on its two sides. The two gears are fixed to the rear ends of two slag rakes by means of two rotating shafts.

There is an oil cylinder connected to the rear end of the rack. It drives the rack to move forward or backward. The flatcar is driven by a motor 7M or hydraulic power to move along the flatcar track. One side of each of the two slag rakes which gathers and clamps slag is in saw-tooth shape.

Comparing the existing slagging-off technology and equipment, the present invention has the following advantages:

(1) The de-slagging rate increased obviously. If the slag amount is not much, just one swing motion of the two slag rakes will rake out over 90% of the slag. And if the slag amount is significant, over 90% of slag can be raked out after two or three swing motions;

(2) The speed for the process of slagging-off increased greatly. It just takes less than 3 minutes for the whole process of slagging-off;

(3) At the final stage of the slagging-off process, the slag rakes ascend and lift away from the surface of the liquid iron. It makes most of the liquid iron left in the rakes flow back to the ladle. Accordingly, the iron loss can be greatly decreased in the slagging-off process, with the loss rate being strictly controlled within 0.1%.

DETAILED DESCRIPTION OF THE PREFERRED EMBODIMENTS

Figure 1:
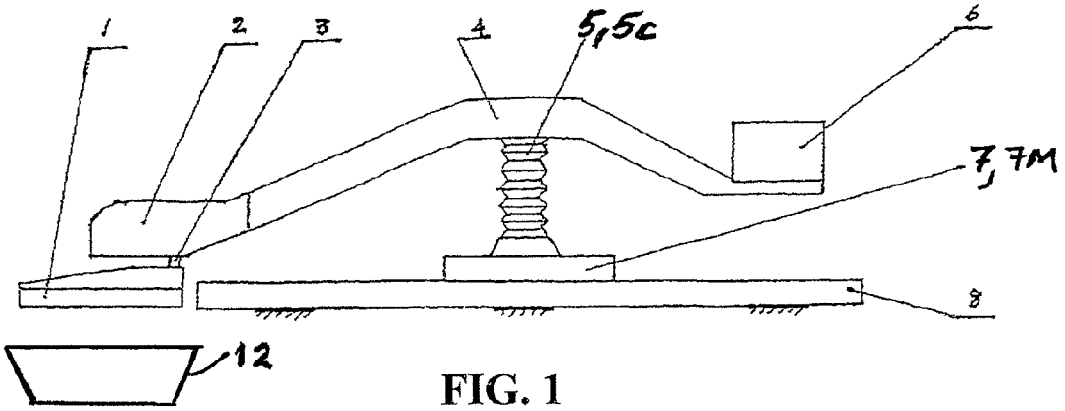
FIG. 1 is a structural schematic diagram of the device for slagging-off of the present invention.
Figure 2:
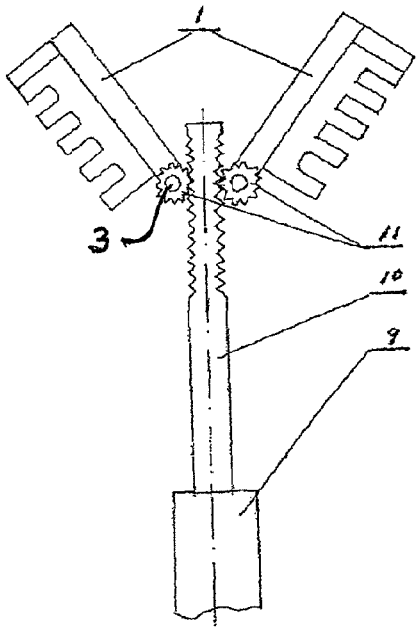
FIG. 2 is a structural schematic diagram of the driving mechanism of the slag rake.

The prevent invention will be more clearly understood by the detailed description of the process of slagging-off that follows herein, which can be taken as one of the preferred embodiments of the high efficient slagging-off method of the present invention.

When the liquid iron ladle moves in and takes its working position, the flatcar, driven by a motor or hydraulic power, moves forward to appropriate working position for the process of slagging-off;

The hoisting main shaft (oil cylinder) starts to operate. It brings the slag rakes down into the liquid iron and beneath the surface at 20 to 50 mm by means of a cantilever;

Hydraulically driven by the oil cylinder, the slag rakes make swinging movements for collecting slag;

When the two slag rakes move to the edge of the liquid iron ladle, the hoisting main shaft (oil cylinder) lifts up the cantilever, which brings the slag rakes up and above the surface at 30 to 100 mm;

Driven by the motor or hydraulic power, the flatcar starts to move backward until to the position where the slag rakes completely leave the space over the liquid iron ladle 12;

The two slag rakes swing in a reverse way, respectively, so as to make the slag in the rakes fall down into the slag hopper in the vicinity of the ladle 12.

The device for implementing the process of slagging-off (the process of scooping-up slag) for the present invention becomes apparent from the following more detailed description, which is only one of the embodiments to implement the aforesaid method. In fact, the method of the present invention can generate many variants of slagging-off equipment of different types of structures.

The device for implementing the process of slagging-off (the process of scooping-up slag) of the present invention comprises a flatcar track 8, a flatcar 7 reciprocating on the track 8 and a cantilever 4 connected to the flatcar 7 by means of a hoisting main shaft 5 (oil cylinder 5C). The rack 10 is fitted at the front end of the cantilever 4. The rack is engaged with the gears 11 on its two sides. The two gears 11 are fixed to the rear ends of two slag rakes 1 by means of the two rotating shafts 3. The slag rakes 1 can be made of refractory material or other materials.

There is an oil cylinder 9 connected to the rear end of the rack 10. It drives the rack 10 to move forward or backward. The slag rakes 1 are driven to make swinging movements by means of the gears 11 and the rotating shaft 3. Practically, there are many ways to drive the slag rakes 1 to make the swinging movement, one of which is a rack 10 and gear method. Other driving methods could utilize a gear, cam, a worm and worm gear, a chain, a belt, an oscillating oil cylinder, or any other hydraulic or electric methods of driving.

The flatcar 7 can be driven to move on the flatcar track 8 either by a motor 7M or by chain mechanism of a hoist. It can also be driven by its own power of the flatcar 7.

One side of each of the two slag rakes 1, which gather and clamp the slag, is in saw-tooth shape, which make it easy for collecting and clamping the slag.

The hydraulic system (oil pump and oil tank) 6 can be fixed to the rear end of the cantilever 4.

Additionally, the cantilever 4 can be designed to be of hydraulic driven type as requested by customer. The flatcar 7 can be driven electrically to ensure the accurate position and the automatic control of the whole process.

What is claimed is:

1. A high efficiency method for scooping-up slag from liquid iron in a ladle, using a device comprising:

a driving device mounted on a front end of a cantilever which is mounted on a hoisting main shaft, two slag rakes driven, respectively, by the driving device, two rotating shafts mounted side-by-side below the driving device, two gears, which are not engaged with each other, are fixed, respectively, to rear ends of the two slag rakes by means of the two rotating shafts mounted side-by-side below the driving device, and a driver for driving the two gears to rotate in opposite directions, the method comprising:

driving the two slag rakes to a predetermined depth beneath a surface of the liquid iron;

swinging the two slag rakes respectively along the surface of the liquid iron by means of the driving device;

during the swinging movement, gradually moving the two slag rakes close to each other, and gathering and clamping the slag from the liquid iron;

while the two slag rakes are clamping the slag, driving the two slag rakes upwardly above the surface of the liquid iron to a predetermined height by means of the cantilever, moving the two slag rakes away from a working position above the liquid iron, and discharging the slag away from the liquid iron.

2. The high efficiency method for scooping-up slag from liquid iron, according to claim 1, further comprising:

(1) when the ladle with the liquid iron is in a working position, using the cantilever for moving the two slag rakes forward to a working position for scooping-up the slag;

(2) using the hoisting main shaft for driving the two slag rakes to the predetermined depth beneath the surface of the liquid iron by;

(3) using the driving device to swing the two slag rakes by rotating the two rotating shafts in the opposite directions, thereby scooping-up the slag;

(4) using an oil pressure in the hoisting main shaft to drive the cantilever upwardly until the two slag rakes are moved upwardly to the predetermined height above the surface of the liquid iron;

(5) using the cantilever to move the two slag rakes away from the working position over the liquid iron by, until the slag rakes are completely away from the position above the liquid iron;

(6) using the driving device to rotate the rotating shafts, respectively, in a reversed way thereby enabling the slag in the slag rakes to fall down away from the liquid.

3. The high efficiency method for scooping-up slag from liquid iron, according to claim 2, the device further comprising:

a rack, wherein the driving device is a driving case, the rack, the two gears, and the driver being fitted inside the driving case, and inside the driving case, the driver is connected to a rear end of the rack, and the rack is engaged with the two gears on opposite sides thereof, and wherein the driver is an oil cylinder, and the rack is driven by the oil cylinder to move forward or backward.

4. The high efficiency method for scooping-up slag from liquid iron, according to claim 3, wherein when the rack moves forward, the two gears connected with the rotating shafts rotate in the opposite directions, thereby swinging the two slag rakes for scooping-up the slag.

5. The high efficiency method for scooping-up slag from liquid iron, according to claim 3, wherein when the rack moves backwards, the two slag rakes are driven, respectively, by the rotating shafts, so as to swing in a reversed way.

6. The high efficiency method for scooping-up slag from liquid iron, according to claim 2, wherein the cantilever is a hydraulically driven cantilever.

7. The high efficiency method for scooping-up slag from liquid iron, according to claim 2, wherein the cantilever is connected to a flatcar by means of the hoisting main shaft, the flatcar reciprocating along a flatcar track, in order to move the two slag rakes to the working position, and to move the two slag rakes completely away from the working position.

8. The high efficiency method for scooping-up slag from liquid iron, according to claim 7, wherein the flatcar is driven by a motor or hydraulic power to move along the flatcar track.

* * * * *